US006607109B2

(12) United States Patent
Stone

(10) Patent No.: US 6,607,109 B2
(45) Date of Patent: Aug. 19, 2003

(54) HOLDER FOR ARTICLES WHICH ATTACHES TO A BELT AND A PANTS BELT LOOP AND METHOD OF USE

(76) Inventor: Tom S. Stone, P.O. Box 19506, Jean, NV (US) 89019-9506

( * ) Notice: Subject to any disclaimer, the term of this patent is extended or adjusted under 35 U.S.C. 154(b) by 103 days.

(21) Appl. No.: 09/970,893

(22) Filed: Oct. 5, 2001

(65) Prior Publication Data

US 2003/0066855 A1 Apr. 10, 2003

(51) Int. Cl.[7] ..... A45F 5/00

(52) U.S. Cl. ..... 224/673; 224/232; 224/678; 224/680; 224/904

(58) Field of Search ..... 224/232, 663, 224/664, 665, 671, 673, 674, 678, 680, 904

(56) References Cited

U.S. PATENT DOCUMENTS 1,821,258 A * 9/1931 Clark ..... 224/674
2,578,237 A * 12/1951 Geistweit ..... 224/673
3,168,971 A * 2/1965 Goertzen ..... 224/673
4,226,105 A * 10/1980 Wehrman ..... 224/674
4,757,927 A * 7/1988 Rutty ..... 224/673
5,146,684 A * 9/1992 Hagler ..... 224/232
5,582,338 A * 12/1996 Tamura ..... 224/678
5,799,847 A * 9/1998 Sandor ..... 224/904
5,915,610 A * 6/1999 Russell ..... 224/673

* cited by examiner

*Primary Examiner*—Gary E. Elkins
(74) *Attorney, Agent, or Firm*—Timothy Thut Tyson; Ted Masters; Freilich, Hornbaker & Rosen

(57) ABSTRACT

A holder for attaching articles to the belt of a user includes at least one aperture though which the belt is threaded. The belt goes between the front side of the holder and the back side of a pants belt loop. An article strap which is connected to an article such as a tool is then threaded in front of the top of the holder, behind the belt, and again in front of the bottom of holder. In this fashion, the pants belt loop and the article strap serve to retain the holder in place with respect to the pants belt loop.

14 Claims, 6 Drawing Sheets

HOLDER FOR ARTICLES WHICH ATTACHES TO A BELT AND A PANTS BELT LOOP AND METHOD OF USE

TECHNICAL FIELD

The present invention pertains to devices for holding articles, and more particularly to a holder for tools, knives, keys, and the like, which is attached to the belt and pants belt loop of a user.

BACKGROUND ART

Devices for holding articles on belts are well known in the art. U.S. Pat. No. 5,582,338 shows a tool holder for carrying a cutting implement, such as a pair of lopping shears, having a plurality of blades attached by a pivot to a pair of elongated handles. The tool holder includes a support backing containing a plurality of vertically extending slots. A waist belt may be passed through the vertically extending slots so that the tool holder may be suspended from the waist belt.

U.S. Pat. No. 5,176,302 illustrates a holder for the handle of a container comprising a substantially rigid, continuous wire-like member bent to form a belt receiving portion and an integral handle receiving portion. The belt receiving portion stabilizes the position of the holder and the handle receiving portion is provided with first and second locking portions through which the container handle must pass before resting at the bottom of the handle receiving portion. The container is thus maintained in a stable, convenient position when the wearer is moving his body and/or walking, freeing the user's hands for other operations while at the same time permitting convenient access to the contents of the can.

U.S. Pat. No. 4,986,459 discloses a tool holder which efficiently organizes a bartender's tools. The tool holder has a pliable support, a first pocket for holding a pen, a hook attached to the first side of the support for holding a bottle opener, a second pocket attached to the first side of the support for holding a lighter, a third pocket attached to the first side of the support for holding a knife, and a ring attached to the first side of the support for holding a towel. The support may be secured to the body of a user by way of a belt so that the second side of the support is adjacent a hip of the user. A hook-and-pile fastening arrangement may be used to releasably fasten the support to the belt at a desired position.

U.S. Pat. No. 4,917,281 shows a holster for carrying a rechargeable electric drill. The holster has a contoured tapering back panel terminating at an upper end in an elongated strap including a snap fastener for securement around a wearer's belt.

U.S. Pat. No. 4,805,819 illustrates a sheath for housing a retractable knife both in its retracted or unretracted state. The sheath has a pair of pockets, one adapted to receive the knife blade and a second adapted to receive the knife when the blade is housed within its handle. The sheath is additionally capable of being folded into a more compact form when housing a retracted knife.

U.S. Pat. No. 4,790,461 shows a holder for a claw hammer having an elongated handle and a claw and head member carried by and projecting generally from one end of the handle. The holder has a waist belt, a support pad carried by the waist belt, and a cradle-like collar defining a tool storage opening for receiving the tool including a partial loop and a hinged gate.

U.S. Pat. No. 4,718,585 is directed to a holster for carrying a hand gun in a compartment on its outer surface. A belt loop is provided on the inner surface of the body. A first tab and a second tab are joined to opposite sides of the body. The tabs include belt loops on their respective inner surfaces. The tabs are aligned on the body so that the belt loops of the first tab, second tab and body can simultaneously receive a belt. When worn, a trouser belt loop can be inserted between the first tab loop and the body loop, or between the second tab loop and the body loop, to prevent the holster from sliding with respect to a belt.

U.S. Pat. No. 2,817,887 pertains to a limb holder for use by fruit pickers, orchardists, and other persons who need to manipulate the limbs and branches of shrubs and trees. The limb holder is removably attached to a person's trouser belt.

DISCLOSURE OF INVENTION

The present invention is directed to a holder for holding articles such as tools. The articles are attached to the holder using an article strap. The present invention is useful in any situation where the user wants to hold an article to his or her belt. The holder is attached to the belt of the user, and cooperates with the belt, a pants belt loop, and the article strap. The interwoven spatial arrangement of the holder, belt, belt loop, and article strap combine to lock the holder to the pants belt loop, even when the user takes the pants off.

In accordance with a preferred embodiment of the invention, the holder includes a flat plate having a first end, an opposite second end, a front side, and an opposite back side. The first end has a first aperture for receiving the belt, and the second end has a second aperture for receiving the belt. The first aperture also receives the article strap. The plate also has a protruding portion which has a hole. The hole may be used to attach a second article or tool.

In accordance with another preferred embodiment of the invention, (1) the back side of the plate is placed on the front side of the pants belt loop, (2) the belt is threaded (feed) through the first aperture, then under the back side of the pants belt loop, then behind the back side of the plate, and through the second aperture, and (3) the article strap is threaded between the front side of the plate and the belt, along the back side of the belt, and between the front side of the plate and the belt again, thereby retaining the holder in place with respect to the pants belt loop.

In accordance with another preferred embodiment of the invention, the second aperture is eliminated, and the holder will still be held in place with respect to the pants belt loop.

In accordance with an important aspect of the invention, the plate is curved to better fit the contour of the user's waist.

In accordance with an important feature of the invention, the front side of the plate has an area upon which indicia such as advertising may be disposed.

In accordance with another important aspect of the invention, the width of the first aperture is wider than the sum of the widths of the pants belt loop and the article strap. In this fashion both the pants belt loop and the article strap will fit in the first aperture.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
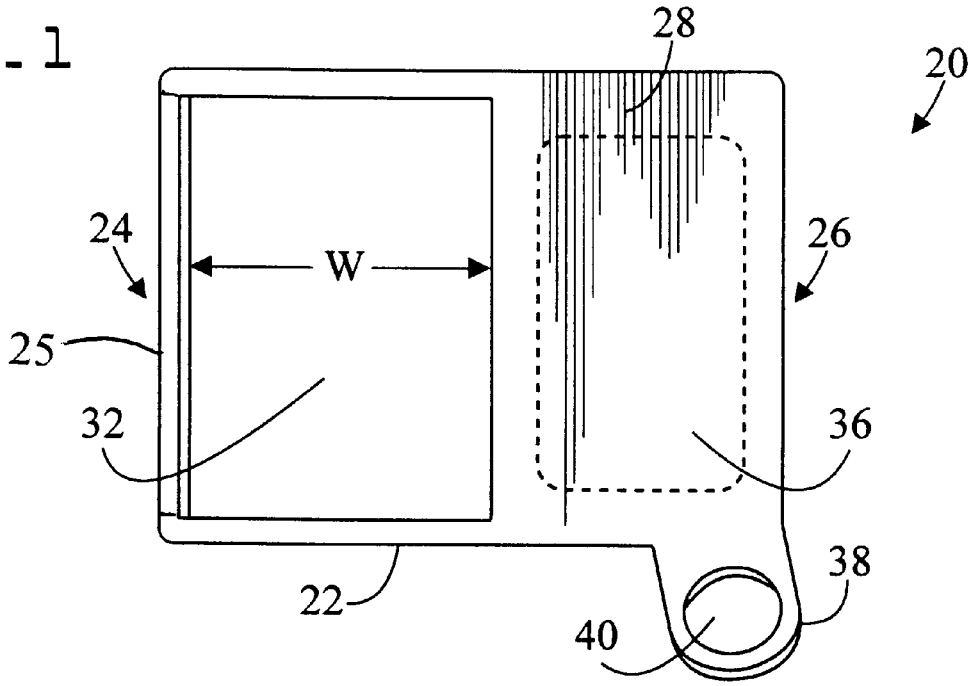
FIG. 1 is a top plan view of a holder for articles in accordance with the present invention.
Figure 2:
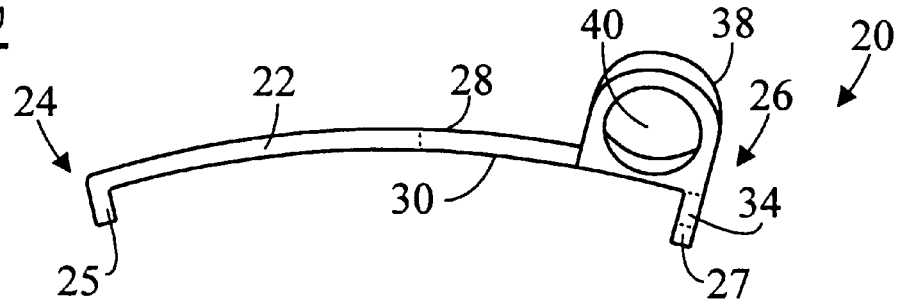
FIG. 2 is a side elevation view of the holder.
Figure 3:
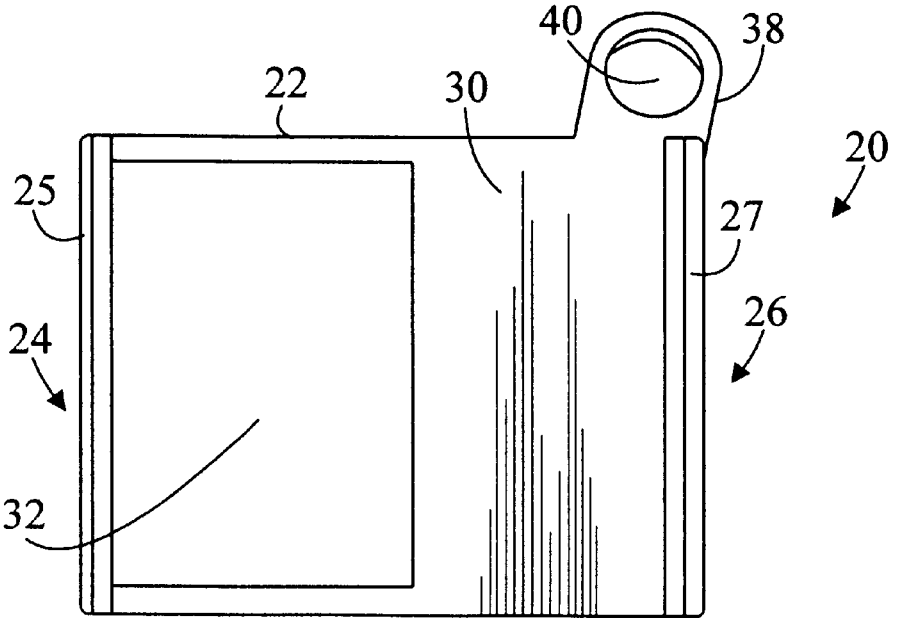
FIG. 3 is a bottom plan view of the holder.
Figure 4:
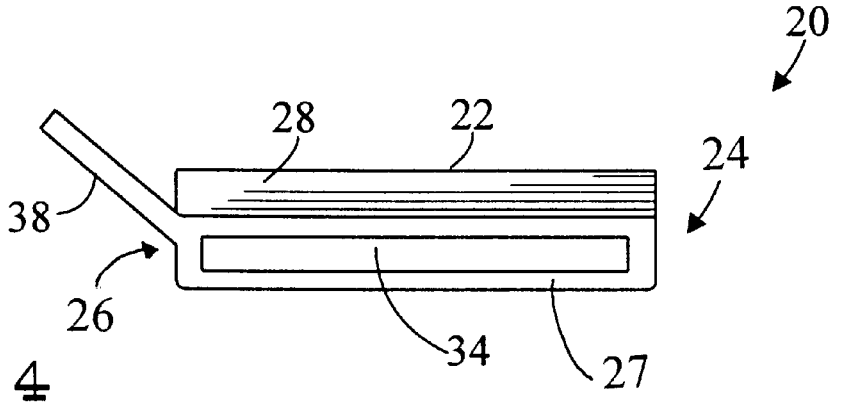
FIG. 4 is an end elevation view of the holder.
Figure 5:
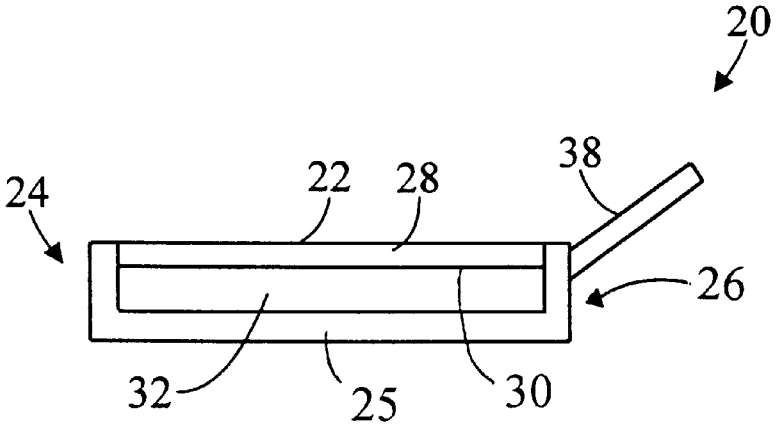
FIG. 5 is an opposite end elevation view of the holder.
Figure 6:
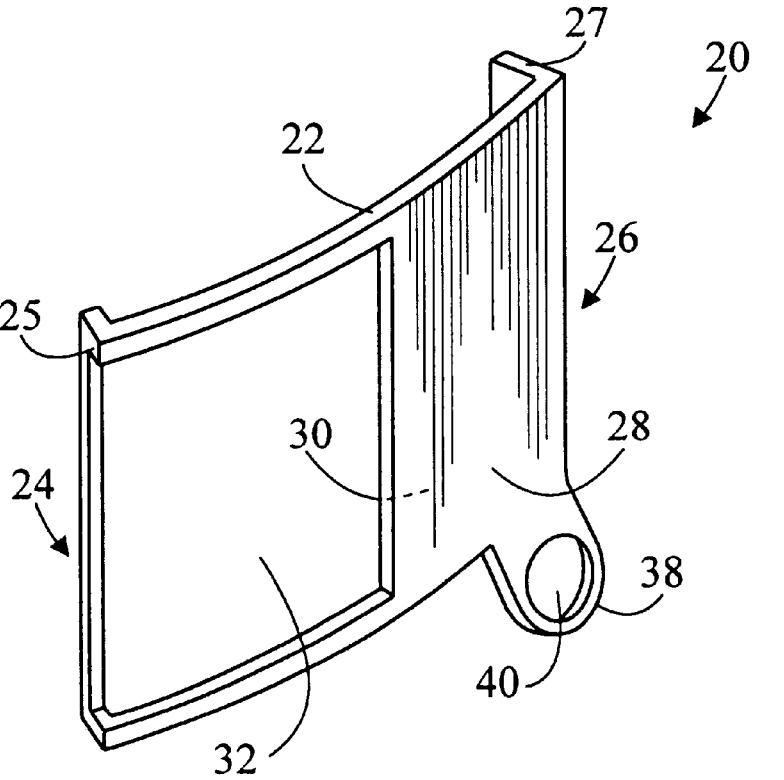
FIG. 6 is a perspective view of the holder.

Referring initially to FIGS. 1–6, there are illustrated top plan, side elevation, bottom plan, end elevation, opposite end elevation, and perspective view, respectively, of a holder for articles which cooperates with a belt, a pants belt loop stitched to pants, and an article strap, the holder generally designated as 20. Also referring to FIGS. 7 and 8, the belt 500 has a front side 502 and an opposite back side 504, the pants belt loop 506 has a front side 508 and an opposite back side 510, and the article strap 512 is connected to an article which is to be held such as a hammer, knife, or the like.

Holder 20 includes a plate 22 which has a first end 24, an opposite second end 26, a front side 28, and an opposite back side 30. First end 24 has a first aperture 32 for receiving belt 500. First aperture 32 has a width W. Second end 26 has a second aperture 34 for receiving belt 500, wherein first aperture 32 is larger than second aperture 34. Front side 28 of plate 22 is convexly curved, and back side 30 of plate 22 is concavely curved. Front side 28 of plate 22 has an area 36 for disposing indicia. It is further noted that first end 24 has a first end portion 25 which is bent toward back side 30, and second end 26 has a second end portion 27 which is also bent toward back side 30. And, plate 22 has a protrusion 38 having a hole 40 for attaching a second article to holder 20.

Figure 7:
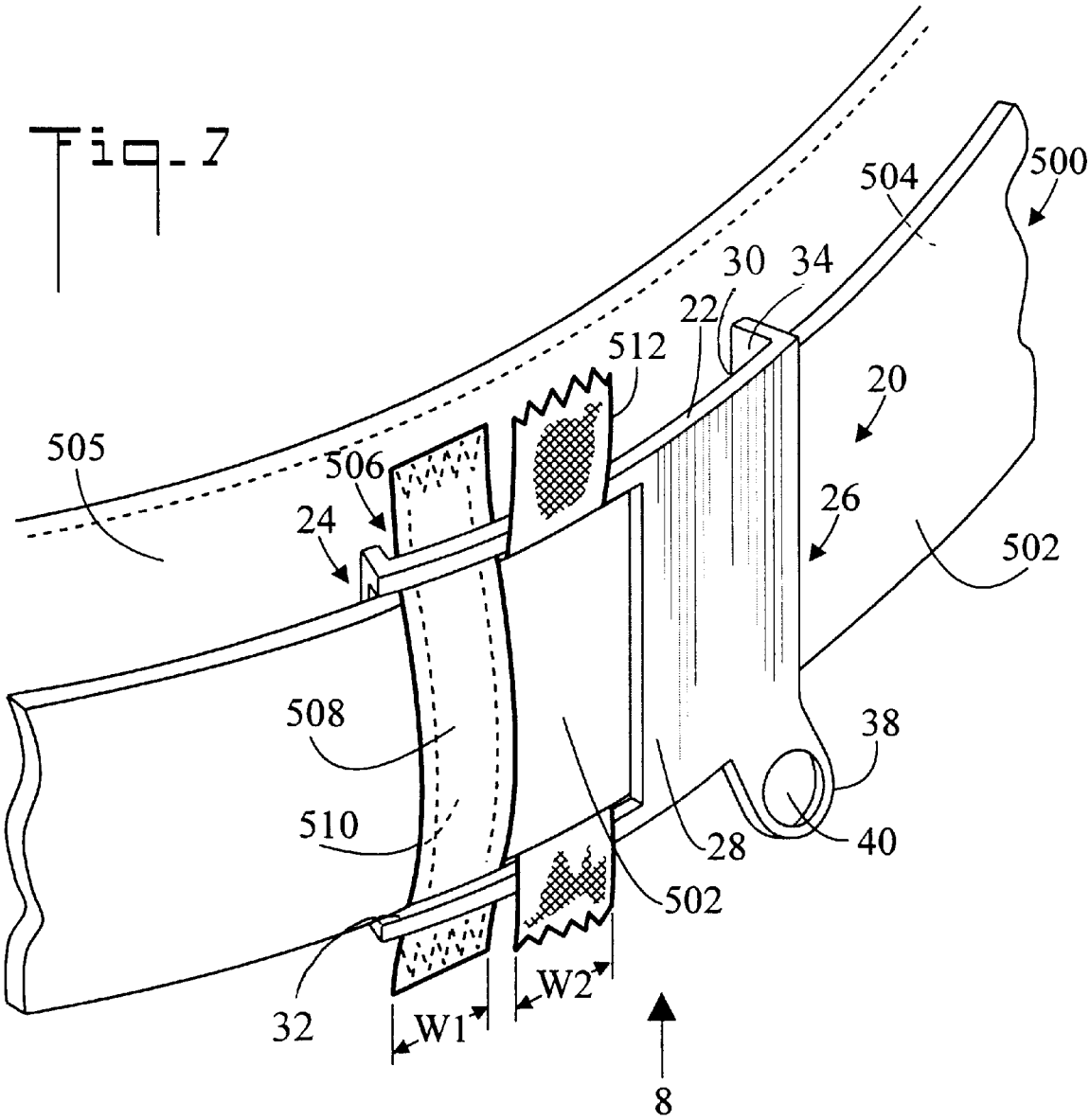
FIG. 7 is a perspective view showing the holder cooperating with a belt, a pants belt loop, and an article strap.
Figure 8:
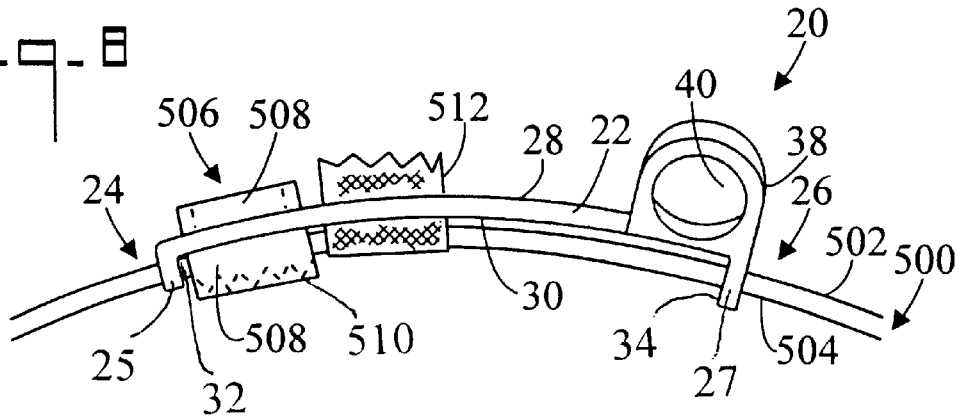
FIG. 8 is a view in direction 8 of FIG. 7.

FIG. 7 illustrates a perspective view showing holder 20 cooperating with belt 500, a pants belt loop 506 located on pants 505, and article strap 512. FIG. 8 is a view in direction 8 of FIG. 7. Back side 30 of plate 22 is placed on front side 508 of the pants belt loop 506. Belt 500 is threaded through first aperture 32 (refer also to FIG. 6), then under back side 510 of pants belt loop 506, then between article strap 512 and whatever it is holding, then behind back side 30 of plate 22, and finally through second aperture 34 (also refer to FIGS. 2 and 4). In this fashion, holder 20 is retained in place with respect to the pants belt loop 506. Put another way, in FIG. 7 it may be observed that holder 20 is prevented from moving to the right by pants belt loop 506, and from moving to the left by article strap 512 and pants belt loop 506. It is noted that article strap 512 is connected to an article such as hammer knife etc. which is not shown. Also it is noted that, pants belt loop 506 has a width W1, and article strap 512 has a width W2. The width W of first aperture 32 (refer also to FIG. 1) is greater than the sum of the widths W1 and W2 of the pants belt loop 506 and article strap 512. It is also noted that in the embodiment of the invention depicted in FIG. 7, article strap 512 is placed between pants belt loop 506 and second end 26. Article strap 512 could alternatively be placed between pants belt loop 506 and first end 24.

Figure 9:
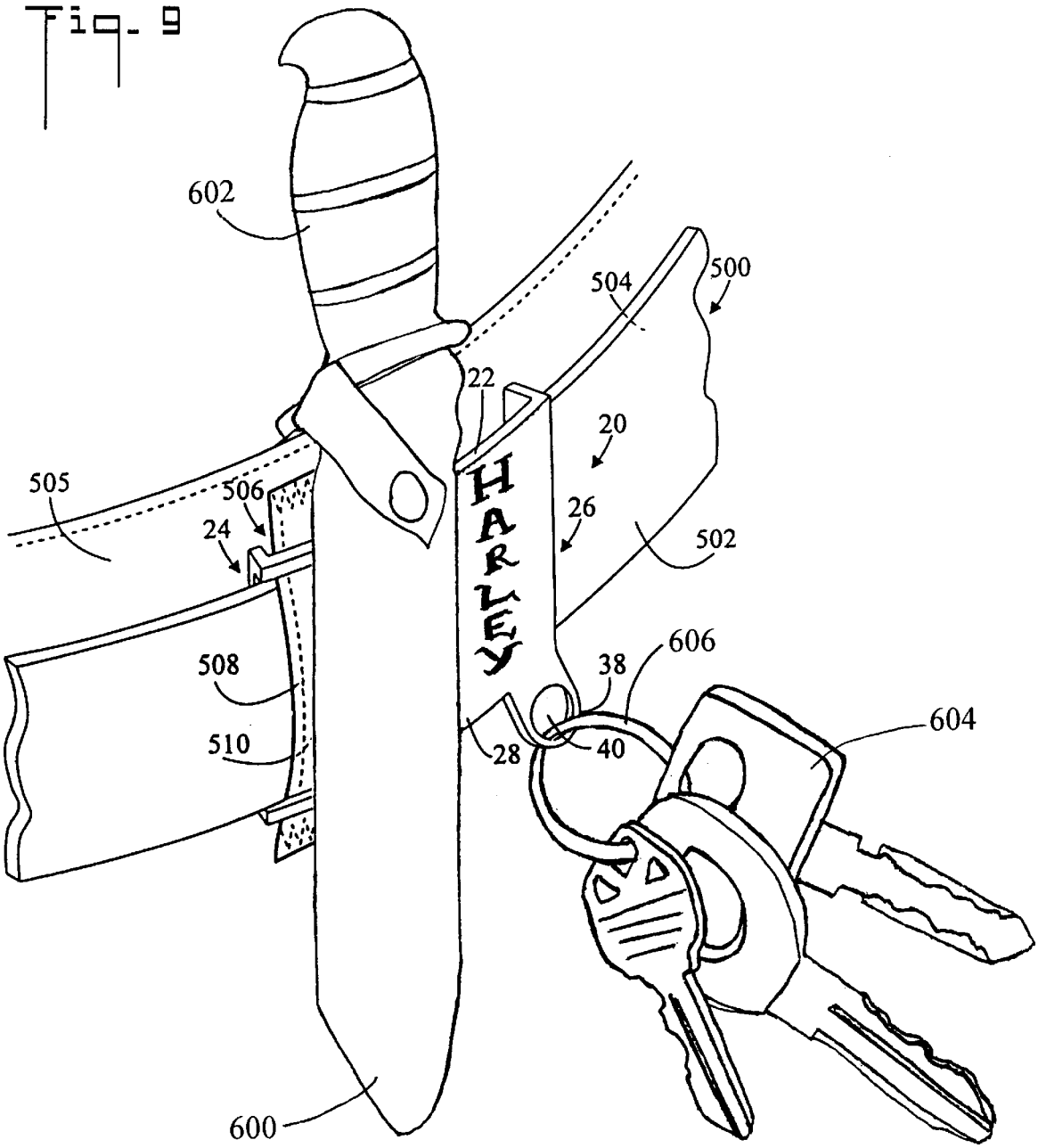
FIG. 9 is a reduced perspective view similar to FIG. 7 showing items attached to the holder.

FIG. 9 is a reduced perspective view similar to FIG. 7 showing a knife sheath 600, knife 602, and a set of keys 604 on a ring 606 attached to the holder 20.

Figure 10:
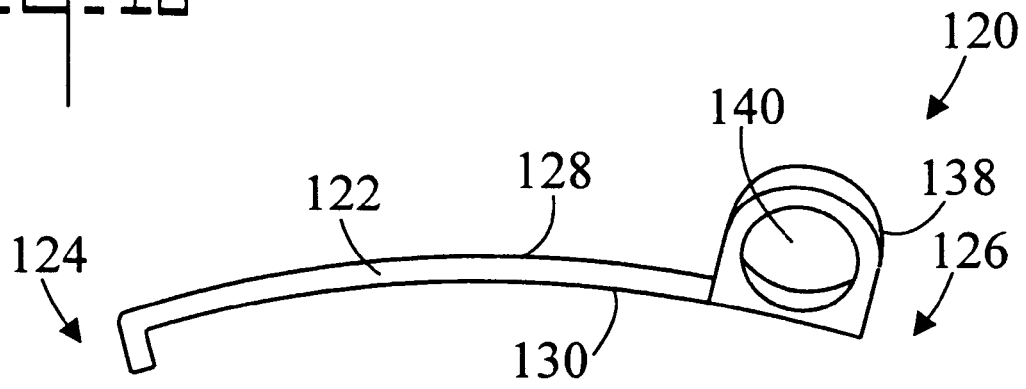
FIG. 10 is a side elevation view of a second embodiment of the holder.
Figure 11:
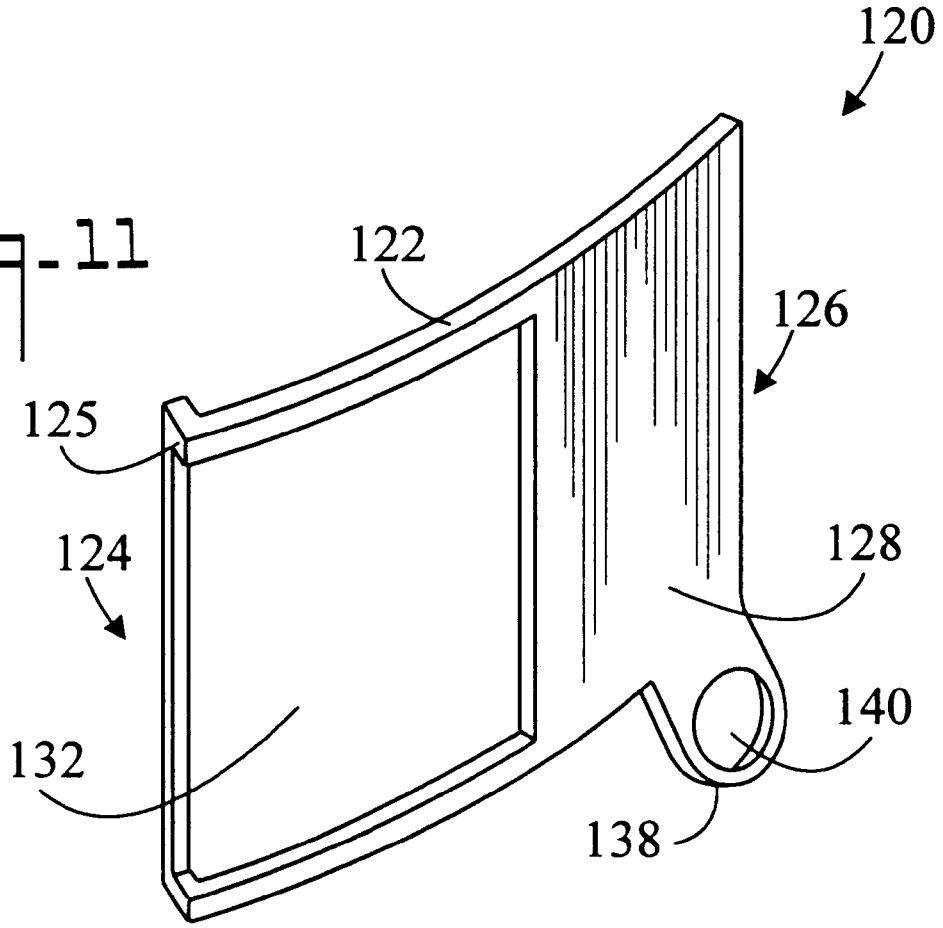
FIG. 11 is a perspective view of the second embodiment holder.

FIGS. 10 and 11 are side elevation and perspective views respectively of a second embodiment of the holder, generally designated as 120. Holder 120 is identical to holder 20 with the exception that holder 120 does not have a second aperture such as second aperture 34 in FIGS. 2 and 4.

Figure 12:
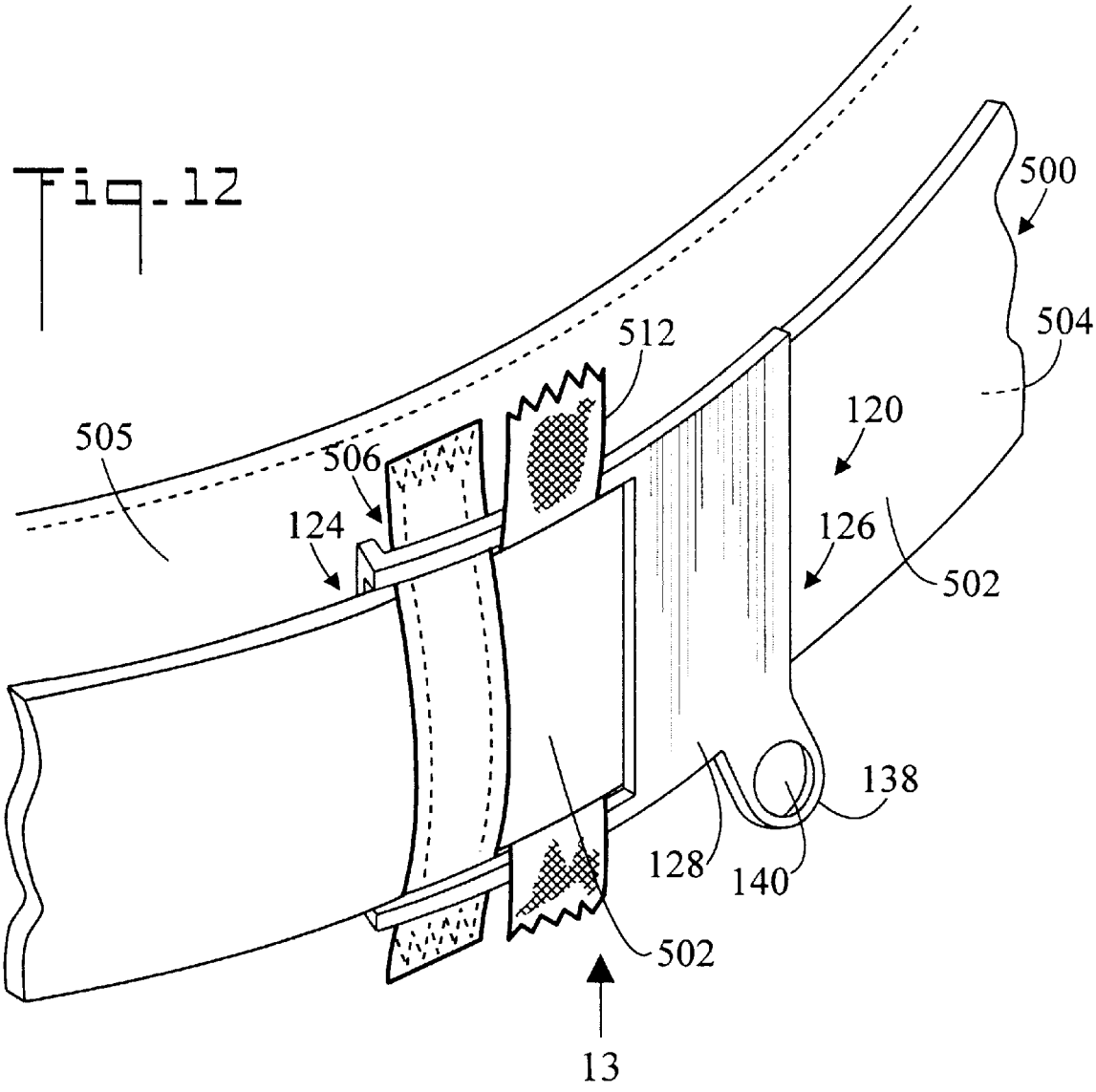
FIG. 12 is perspective view showing the second embodiment holder cooperating with a belt, a pants belt loop, and an article strap; and, FIG. 13 is a view in direction 13 of FIG. 12.
Figure 13:
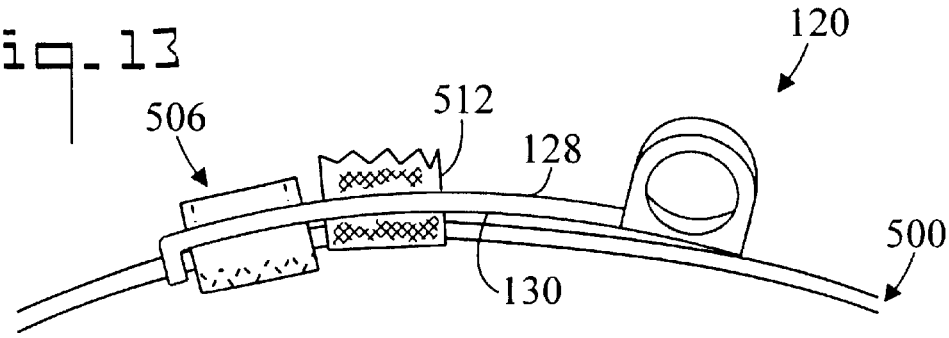

FIG. 12 is perspective view showing holder 120 cooperating with a belt 500, a pants belt loop 506, and an article strap 512. FIG. 13 is a view in direction 13 of FIG. 12. It is noted that pants belt loop 506 and article strap 512 serve to retain holder 120 in place with respect to the pants belt loop 506, just as in holder 20.

The holder 20 of the present invention is preferably fabricated from metal such as brass, bronze, or aluminum.

In terms of use, a method for holding articles, comprises:

(1) providing a belt 500 having a front side 502 and a back side 504;

(2) providing pants 505 having a pants belt loop 506 having a front side 508 and a back side 510;

(3) providing an article strap 512;

(4) providing a holder 20 including a plate 22 having a first end 24, an opposite second end 26, a front side 28, an opposite back side 30, the first end 24 having a first aperture 32 for receiving the belt 500, and the plate 22 having a protrusion 38 having a hole 40;

(5) placing back side 30 of plate on front side 508 of pants belt loop 506;

(6) threading belt 500 through first aperture 32, then under the back side 510 of pants belt loop 506, then behind back side 30 of plate 22; and, (7) threading article strap 512 between the front side 28 of plate 22 and belt 500, along back side 504 of belt 500, and again between front side 28 of plate 22 and belt 500, thereby retaining holder 20 in place with respect to the pants belt loop 506.

The method also includes:

providing a second article; and, using hole 40, attaching the second article to holder 20.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A holder which cooperates with a belt having a front side and a back side, a pants belt loop having a front side and a back side, and an article strap, said holder comprising:

a plate having a first end, an opposite second end, a front side, and an opposite back side;

said first end having a first aperture for receiving the belt;

said second end having a second aperture for receiving the belt, said first aperture larger than said second aperture;

so that (1) said back side of said plate may be placed on the front side of the pants belt loop, (2) the belt threaded through said first aperture, then under the back side of the pants belt loop, then behind said back side of said plate, and through said second aperture, and (3) the article strap threaded between said front side of said plate and the belt, along the back side of the belt, and between the front side of said plate and the belt again, thereby retaining said holder in place with respect to the pants belt loop; and, said plate having a protrusion having a hole.

2. A holder according to claim 1, further including:

said front side of said plate convexly curved, and said back side of said plate concavely curved.

3. A holder according to claim 1, further including:

said front side of said plate having an area for disposing indicia.

4. A holder according to claim 1, the pants belt loop having a width and the article strap having a width, said holder further including:

said first aperture having a width which is greater than the sum of the widths of the pants belt loop and article strap.

5. A holder according to claim 1, further including:

said first end having a first end portion which is bent toward said back side; and, said second end having a second end portion which is bent toward said back side.

6. A holder according to claim 1, the pants belt loop having a width and the article strap having a width, said holder further including:

said front side of said plate convexly curved, and said back side of said plate concavely curved;

said front side of said plate having an area for disposing indicia;

said first aperture having a width which is greater than the sum of the widths of the pants belt loop and article strap;

said first end having a first end portion which is bent toward said back side; and, said second end having a second end portion which is bent toward said back side.

7. A holder which cooperates with a belt having a front side and a back side, a pants belt loop having a front side and a back side, and an article strap, said holder comprising:

a plate having a first end, an opposite second end, a front side, and an opposite back side;

said first end having a first aperture for receiving the belt;

so that (1) said back side of said plate may be placed on the front side of the pants belt loop, (2) the belt threaded through said first aperture, then under the back side of the pants belt loop, then behind said back side of said plate, and (3) the article strap threaded between said front side of said plate and the belt, along the back side of the belt, and between the front side of said plate and the belt again, thereby retaining said holder in place with respect to the pants belt loop; and, said plate having a protrusion having a hole.

8. A holder according to claim 7, further including:

said front side of said plate convexly curved, and said back side of said plate concavely curved.

9. A holder according to claim 7, further including:

said front side of said plate having an area for disposing indicia.

10. A holder according to claim 7, the pants belt loop having a width and the article strap having a width, said holder further including:

said first aperture having a width which is greater than the sum of the widths of the pants belt loop and article strap.

11. A holder according to claim 7, further including:

said first end having a first end portion which is bent toward said back side.

12. A holder according to claim 7, the pants belt loop having a width and the article strap having a width, said holder further including:

said front side of said plate convexly curved, and said back side of said plate concavely curved;

said front side of said plate having an area for disposing indicia;

said first aperture having a width which is greater than the sum of the widths of the pants belt loop and article strap; and, said first end having a first end portion which is bent toward said back side.

13. A method for holding articles, comprising:

(1) providing a belt having a front side and a back side;

(2) providing pants having a pants belt loop having a front side and a back side;

(3) providing an article strap;

(4) providing a holder including a plate having a first end, an opposite second end, a front side, an opposite back side, said first end having a first aperture for receiving the belt, and said plate having a protrusion having a hole;

(5) placing said back side of said plate on the front side of the pants belt loop;

(6) threading the belt through said first aperture, then under the back side of the pants belt loop, then behind said back side of said plate; and, (7) threading the article strap between said front side of said plate and the belt, along the back side of the belt, and between the front side of said plate and the belt again, thereby retaining said holder in place with respect to the pants belt loop.

14. The method according to claim 13, further including:

providing a second article; and, using said hole, attaching the second article to said holder.

* * * * *